United States Patent [19]

Adler

[11] Patent Number: 4,630,715

[45] Date of Patent: Dec. 23, 1986

[54] BOTTOM ROD SAFETY GUARD FOR RAILWAY BRAKE RIGGING

[75] Inventor: Frank P. Adler, Michigan City, Ind.

[73] Assignee: Trans-Dyne, Incorporated, Chicago, Ill.

[21] Appl. No.: 618,919

[22] Filed: Jun. 8, 1984

[51] Int. Cl.[4] ..... B61H 13/34

[52] U.S. Cl. ..... 188/210

[58] Field of Search ..... 188/206 R, 207, 210; 294/74; 122/510; 133/106, 107; 248/60, 62, 323; 211/60 R; 280/480; 24/17 A, 19, 115 H, 298, 299, 300, 301, 302; 410/96, 97; 213/76

[56] References Cited

U.S. PATENT DOCUMENTS

| | | | |
|---|---|---|---|
| 1,841,600 | 1/1932 | Haskell | 188/210 |
| 3,092,213 | 6/1963 | Nelson | 188/210 |
| 3,965,938 | 6/1976 | Baurele et al. | 248/60 |
| 4,135,608 | 1/1979 | Adler | 188/210 |

FOREIGN PATENT DOCUMENTS

| | | | |
|---|---|---|---|
| 0647389 | 12/1928 | France | 24/115 H |

OTHER PUBLICATIONS

"Elastic Hold-Downs" J. C. Whitney & Co., Chicago, IL, catalog No. 420B, 1982, p. 126.

*Primary Examiner*—Duane A. Reger
*Assistant Examiner*—Alvin Oberley
*Attorney, Agent, or Firm*—Gary, Juettner & Pyle

[57] ABSTRACT

In railway brake rigging wherein a bottom actuating rod extends beneath the bolster, a safety guard is provided to prevent a broken or disconnected rod from falling onto the track structure. The safety guard, which does not require any disassembly of the rigging or special tools, comprises a flexible cable having a pair of strands at each end of predetermined length. The end of one strand is secured to a connector, and the end of the other strand is releasably secured to the connector through a slotted opening. The safety guard is easily installed by looping the strands at both ends of the cable around the brake beam and securing the free strands to the connector.

13 Claims, 3 Drawing Figures

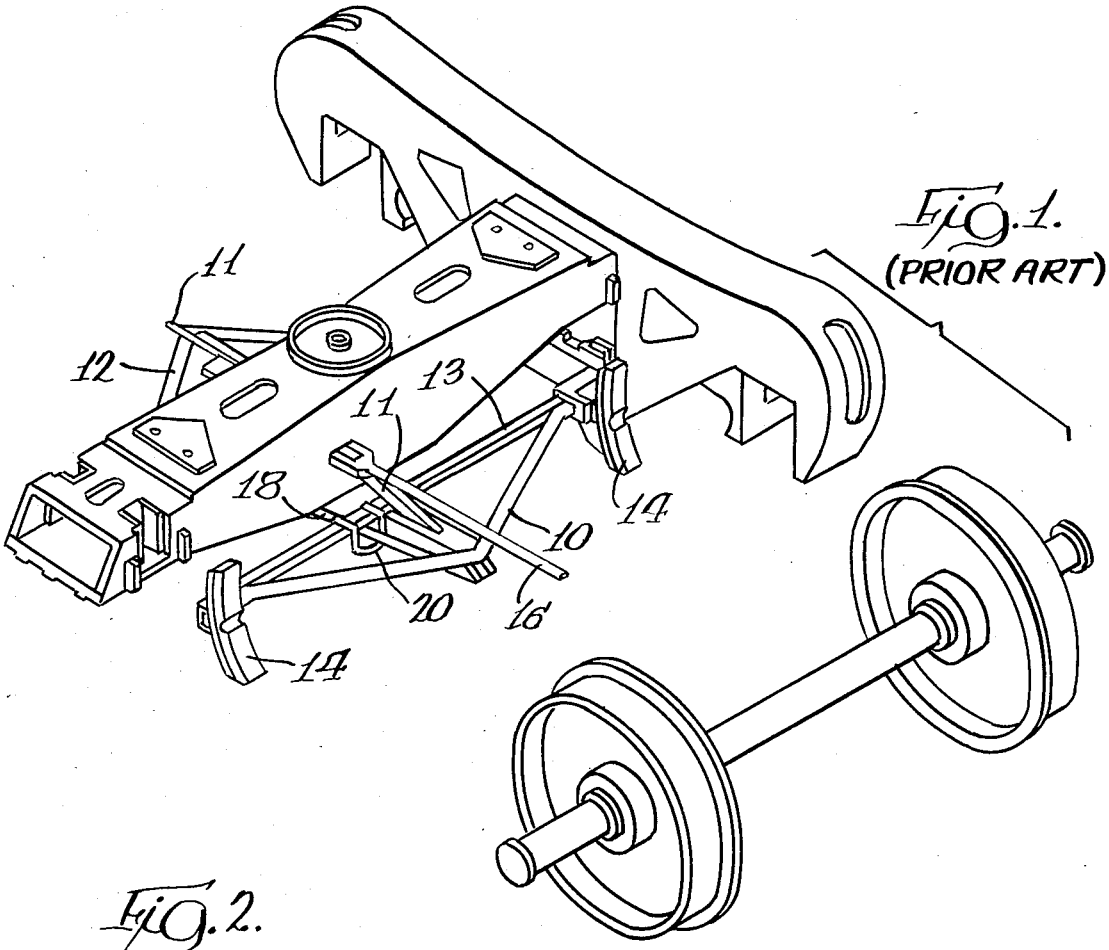
Fig. 1.
(PRIOR ART)
Fig. 2.
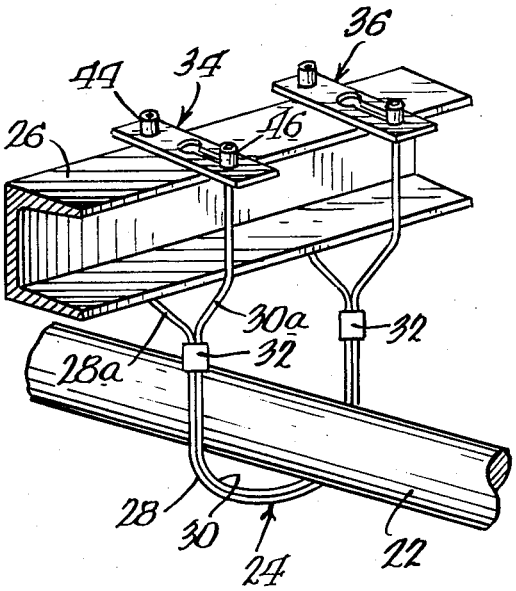
Fig. 3.
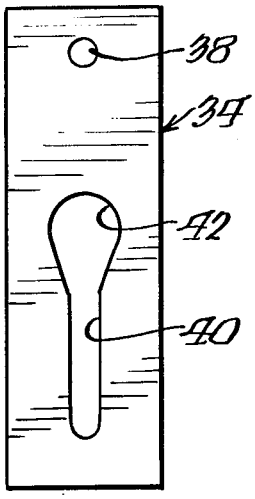

BOTTOM ROD SAFETY GUARD FOR RAILWAY BRAKE RIGGING

BACKGROUND OF THE INVENTION

This invention relates to improvements in railway vehicles and more particularly to improvements associated with brake rigging in railway vehicles.

In a typical railway freight car, an air cylinder is connected by an assortment of levers and rods to brake shoes associated with each of the wheels. In many cases, a connecting rod extends beneath the bolster of the railway truck, and there is nothing to support the bottom rod in the event that it becomes disconnected or broken. In such cases, the truck is required to be equipped with safety guards, which are in the form of a loop connected from the brake beams or other structure under the car.

Various types and styles of safety guards are described in the following U.S. Pat. Nos. 1,841,600; 2,077,547; 3,703,225; 4,135,608; and 4,195,715. One of the original types is a continuous, rigid steel loop having a pair of U-shaped legs that are driven downwardly onto the brake beam, similar to that shown in U.S. Pat. No. 3,703,225. Obviously, replacement of such a device can be very cumbersome and time consuming, and the minimum clearance above the track structure often allows the guard to become broken, bent or dislodged by striking objects between the rails and the lack of a serviceable guard creates a dangerous condition. Also, since the space beneath the car is limited, insertion of a replacement and the driving or hammering operations are awkward. Moreover, the bottom rod must be removed and reinstalled after the new guard has been secured in position.

Various improvements have been suggested in the patents mentioned above, such as U-shaped brackets or cables having end terminals that are bolted to the truck structure. In all cases, however, it is necessary to drill holes or secure the necessary brackets, which operations are time consuming and expensive. It would be desirable to provide a safety guard that could be installed on an existing truck, especially as a replacement item, without the need for special tools or disassembly of the brake rigging, and to provide such a guard that is reliable and easy to install.

SUMMARY OF THE INVENTION

In accordance with the present invention, a bottom rod safety guard is provided and comprises a pair of flexible cables, which are secured together near their ends to provide a flexible strap having opposite pairs of free ends. The free ends are connected around a brake beam to define a loop around the bottom rod. The cable ends are connected in position by means of a pair of brackets that overlie the top of the brake beam compression member, with the cable ends extending downward on either side of the brake beam. One of each pair of the strands is secured at one side of the bracket, and the other strand is releasably secured into a slotted hole at the other side of the bracket. The strands and bracket are dimensioned such that, after installation, the releasable strand is held in a locked position between the bracket and brake beam.

THE DRAWING

FIG. 1 is a perspective view of a conventional railway car brake assembly illustrating the brake beams, bottom connecting rod and safety guard.

FIG. 2 is a perspective view of the bottom rod safety guard installed on a brake beam, with only fragments on the brake beam and bottom rod being shown for the sake of clarity.

FIG. 3 is a plan view of one of the brackets used in connection with the bottom rod safety guard of the present invention.

DESCRIPTION OF THE PREFERRED EMBODIMENT

FIG. 1 illustrates one type of conventional railway brake rigging comprising a pair of spaced brake beams 10 and 12 carrying brake shoe assemblies 14 at the ends thereof to engage respective wheels (not shown) of the railway truck.

A body mounted brake cylinder (not shown) is provided to move the top rod 16, which operates the truck levers 11 and the brake beams 10 and 12. A bottom rod 18 is utilized to operate the brake lever and brake beam on the outboard side of the bolster.

Since there is no support structure beneath the rod 18, safety guards 20 are provided. In the arrangement shown, the brake beams are comprised of spaced compression and tension members, and the safety guards 20 are in the form of hangers press fitted downwardly on the channel-shaped compression members 13.

In general, safety guards that are press fitted have not proved to be entirely satisfactory in service. Many of such devices are made from steel rod and are difficult to install. Also they are easily broken, bent or dislodged by objects laying between the rails. Proposals to secure flexible cables by bolting to the beams have been made, but the bolted connection is not entirely reliable and requires special tools.

As shown in FIGS. 2 and 3, the bottom rod safety guard of the present invention is relatively simple, easy to install, requiring no special tools, and also does not require removal of the bottom rod 22 or other disassembly of the rigging. The guard, generally indicated at 24, is in the form of a dual strand cable having opposite free ends that are connected around the brake beam compression member 26.

Thus, the safety guard comprises a pair of flexible cables 28 and 30, preferably of substantially equal length. The cables may be and preferably are composed of galvanized wire rope having a plurality of wires twisted together to define a single flexible and resilient cable. The cables 28 and 30 are arranged generally in parallel, and an intermediate or medial portion of the cables are secured together, such as by the use of spaced sleeves 32. The medial portion between the sleeves 32 is flexible and can form a loop of two strands. The sleeves 32 are also spaced from the ends of the cables to define opposite free end portions, such as **28*a* and 30*a***.

Rather than bolting the ends of the cables to the compression member 26, they are suspended from a pair of plates 34 and 36 which extend over and rest on the top of the compression member in a laterally spaced relationship. As shown in FIG. 3, each of the plates, such as 34, is elongated so as to be wider than the width of the top of the compression member. A round opening 38 is provided near one end of the plate 34, and a slotted opening 40 in the form of a keyhole is provided near the other end, said slotted opening having an enlarged portion 42 near the central portion, which tapers into a more confined slot near the end of the plate.

The opening 38 and slot 40 are slightly larger in diameter than the diameter of the cable ends 28*a* and 30*a* such that the ends may pass through the openings. Each of the ends 28*a* and 30*a* are provided with terminal stops 44 and 46, which may be in the form of a bushing or ferrule swaged onto the ends of the cables. The stops 44 and 46 have a diameter larger than the diameter of the opening 38 and slot 40, whereas the enlarged portion 42 of the slot is larger in diameter than the stop 46. In this manner, cable end 30*a* may be releasably secured to the plate 34 by passing the stop 46 through the opening 42 and then moving the cable toward the end of the plate, thereby providing a non-threaded, latching engagement.

From the foregoing, it will be appreciated that the safety guard is fabricated with one of the end pairs 28*a* permanently secured to the plate 34, with the other end 30*a* to be secured upon installation of the guard. Upon installation, it may be seen that the opening 38 and the confined end of the slot 40 are sufficiently spaced to allow the cable ends 28*a* and 30*a* to hang vertically down on either side of the brake beam. Being a safety guard, the bottom loop portion of the guard is normally spaced below the bottom rod 22 and normally does not come into contract with the rod.

In order to secure the cable 30*a* into the slotted opening 40, sufficient slack is provided from the sleeve 32 to allow the plate 34 to be either pushed over or raised, whereupon the stop 46 is inserted through the enlarged opening 42. The width of the compression member 26 and the resiliency of the cables cause the enlarged end 46 to be latched or retained in the narrow portion of the slot 40, so that the guard remains secured around the beam. The degree of slack is determined by the position of the sleeve 32, and the slack is just sufficient to enable installer to pass the end 46 through the enlarged opening.

It may be seen from the foregoing discussion that the length of the cable ends 28*a* and 30*a* between the sleeve 32 and the bottom of the brake beam 26 provides a safety feature, since the width of the beam, generally rectangular in cross-section, tends to force the cable ends or legs apart and retains the cable end 46 in a secure position.

While the securement of the guard has been described only in connection with the plate 34, it will be understood that the other plate 36 is connected in the same manner to complete the loop. The natural resiliency of the cables tends to force the plates 34 and 36 apart in a spaced relation.

I claim:

1. A railway brake bottom rod safety guard adapted to hang from a supporting part of a railway vehicle, said safety guard compring a flexible elongate member, first and second pairs of flexible legs extending from opposite ends of said flexible member, a pair of plates adapted to rest on the upper surface of said supporting part in a spaced relation, and means for attaching said first and second pairs of flexible legs to the respective plates comprising means for securing one leg near one end of the plate, and means for releasably attaching the other leg near the other end of said plate to allow the flexible member and plate assembly to be installed and removed.

2. The safety guard of claim 1 wherein said flexible elongate member comprises a pair of individual flexible cables, and means for securing said cables together.

3. The safety guard of claim 2 wherein the means for securing said cables together comprise a pair of sleeves secured around said cables in a spaced relation.

4. The safety guard of claim 3 wherein said legs are defined by said cables, and wherein said sleeves are spaced from the ends of said legs.

5. The safety guard of claim 1 wherein said pair of legs and said plate encircle and are supported by said supporting part.

6. The safety guard of claim 1 wherein the means for releasably attaching the other leg near the other end of the plate comprises an enlarged terminal at the end of said other leg, a slot in said plate, a relatively enlarged portion of said slot located medially in said plate, said terminal being insertable through said enlarged opening to engage the remainder of said slot.

7. A railway brake bottom rod safety guard adapted to hang from a supporting part of the railway vehicle and to encircle the bottom rod, said safety guard comprising a pair of elongated flexible cables of substantially equal length, first means spaced from the respective ends of said cables for securing said cables together to define a common medial portion and pair of legs at each end, a plate corresponding to each pair of legs, second means securing the end of one leg to the plate, and third means for providing a latching engagement between said plate and the other of said legs, said plate resting on the upper surface of said supporting part, and said plates and cables being installable as an assembly.

8. The safety guard of claim 7 whrein said third means comprises an elongated slot in said attachment plate, an enlarged area of said slot in an inward portion thereof, and an enlarged end on said other leg, said enlarged end being latchable through said enlarged area and into said slot.

9. The safety guard of claim 7 wherein said first means comprises a pair of spaced ferrules.

10. The safety guard of claim 7 wherein said second means comprises an opening through said plate near one end thereof, said one leg passing through said opening, and an enlarged terminal at the end of said one leg.

11. The safety guard of claim 10 wherein said third means comprises an elongated slot at the other end of said attachment plate and having an enlarged portion spaced from said end, and an enlarged end on said other leg, said other leg being latchable into said slot by passing said enlarged end through said enlarged opening.

12. The safety guard of claim 7 wherein said plate extends across the width of said supporting part and retains the latching engagement between said plate and the other of said legs.

13. A bottom rod safety guard adapted to hang from a supporting part of a railway vehicle and extend around a brake rod, said safety guard comprising an elongated plate adapted to rest on the upper surface of said supporting part, said plate being longer than the width of said supporting part, a flexible cable having a pair of ends, means for securing one of the cable ends to one end of the plate beyond the width of said supporting part, and latching means for releasably attaching the end of the other cable end to the other end of said plate, said latching means comprising a slot in said plate having an enlarged opening located inwardly of the width of said support member, said other cable end having an enlarged terminal passible through said opening and being retained by said slot, the width of said supporting part serving to retain said other cable end in latched position.

* * * * *